United States Patent [19]

McMillan

[11] 4,023,291

[45] May 17, 1977

[54] COMBINATION BOOTSCRAPER AND NAMEPLATE

[76] Inventor: William L. McMillan, 8008 Peach Tree Lane, Wichita, Kans. 67207

[22] Filed: June 23, 1976

[21] Appl. No.: 698,830

[52] U.S. Cl. ..... 40/125 H; 15/237; 40/210

[51] Int. Cl.[2] ..... G09F 7/00

[58] Field of Search ..... 40/129 C, 125 R, 125 H, 40/209, 210; 15/237

[56] References Cited

UNITED STATES PATENTS

| | | | |
|---|---|---|---|
| 1,132,646 | 3/1915 | Bauman | 15/237 |
| 1,203,936 | 11/1916 | Strubhar | 15/237 |
| 2,312,183 | 2/1943 | Murfin | 40/210 |
| 2,646,864 | 8/1953 | Wiltse | 15/237 |
| 3,103,681 | 9/1963 | Crook | 15/237 |
| 3,908,296 | 9/1975 | Harrison | 40/129 C |

*Primary Examiner*—Louis G. Mancene
*Assistant Examiner*—Wenceslao J. Contreras
*Attorney, Agent, or Firm*—Edward L. Brown

[57] ABSTRACT

An advertising device carrying a name on the scraper plate and having an attachment bracket which can be used as a stake to fix the bootscraper to the earth. The same attachment bracket can also fasten the name-bearing plate to the license plate support of a vehicle.

7 Claims, 3 Drawing Figures

COMBINATION BOOTSCRAPER AND NAMEPLATE

BACKGROUND OF THE INVENTION

A bootscraper is a metal device fixed upright near an entrance used to scrape mud, dirt, etc., from shoes and boots. It consists of a horizontal blade on edge for scraping the bottoms of soles and usually has vertically projecting ears to scrape the edge of soles. It is supported by stakes or fastened to a stoop. Nameplates are well known and are used to inform, to advertise, and for other uses. The use of a combination bootscraper, nameplate and bracket as an advertising device is new and novel.

BRIEF SUMMARY OF THE INVENTION

This bootscraper, the metal plate of which is also a nameplate, is combined with a novel metal bracket which serves as a stake when the bootscraper is staked to the ground and also serves as a bracket for mounting the stake to a vertical surface such as the license plate support of a motor vehicle.

The invention has utility as an advertising device with its dual function in that companies can give the device to selected persons and gain a widespread permanent display of their name and trademark.

An object of this invention is to provide a combination bootscraper and nameplate having a bracket facilitating affixing the device to the ground by staking or to an automobile license plate.

Another object of this invention is to combine the attractiveness and the utility of a combination bootscraper and nameplate into an advertising device in order to gain widespread display of the advertiser's name by individuals to whom the device is supplied.

The novel and useful features which are considered characteristic of the invention are set forth in particular in the claims. The invention will be best understood from the summary above and from the following detailed description and the accompanying drawings.

DESCRIPTION OF THE PREFERRED EMBODIMENT

Figure 1:
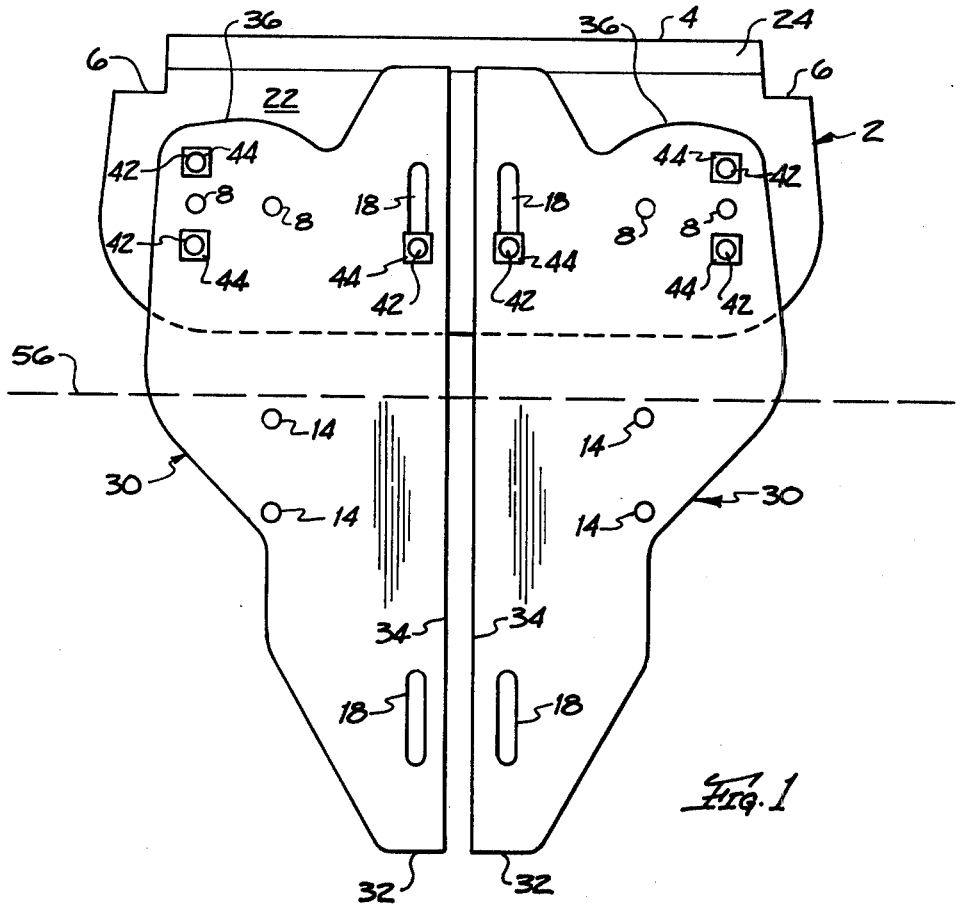
FIG. 1 is a rear view of an embodiment of the invention showing two metal brackets positioned vertically as stakes.

Referring first to FIG. 1, there is shown a metal plate 2 having: a sharp top edge 4 formed by bevel 24, reentrant notches 6 at its top corners, and a rear surface 22. There is also shown a pair of irregularly shaped metal brackets 30 fastened to plate 2 by bolts 42 and nuts 44. The long straight sides 34 of brackets 30 are positioned vertically and adjacent to each other, the pointed ends 32 of brackets 30 are at the bottom and the blunt ends 36 are at the top. Holes 8, 14 and slots 18 through bracket 30 are shown. There are also holes 12 through bracket 30 (FIG. 2), but not shown in FIG. 1. For the same reason holes 10 and 16 in plate 2 are not shown in FIG. 1, but can be seen in FIG. 2. When brackets 30 are in a vertical position as stakes, as shown in FIG. 1, holes 12 of brackets 30 align with holes 10 in plate 2 and the upper slots 18 in brackets 30 align with holes 16 in plate 2.

Figure 2:
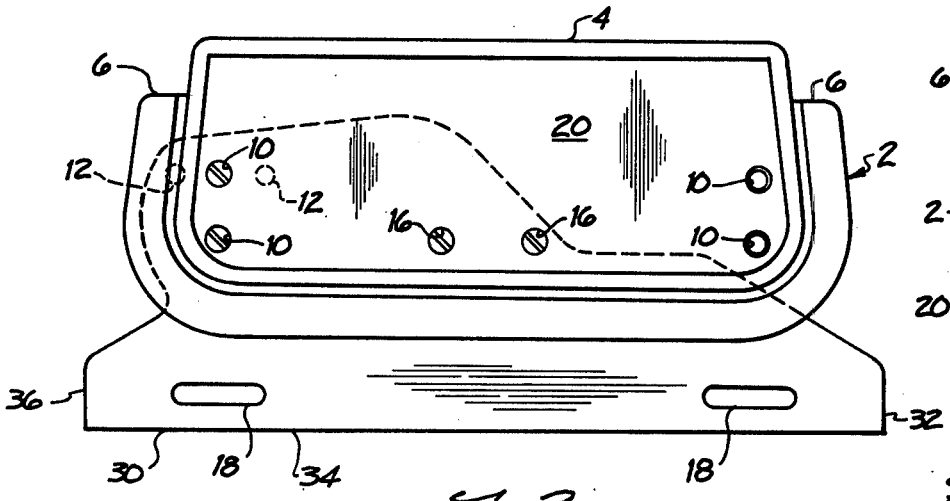
FIG. 2 is a front view of the embodiment of the invention shown in FIG. 1 except showing but a single metal bracket.

Now referring to FIG. 2, holes 10 and 16 of plate 2 are shown, as well as holes 12 and slots 18 of bracket 30. Holes 14 and 8 in bracket 30 are not shown but line up respectively with holes 16 and the left holes 10 in plate 2. Bracket 30 is in a horizontal position with the long straight side 34 lying horizontally and below plate 2. For the sake of clarity, bolts 42 are not shown in FIG. 2 but would be installed in holes 16 and the left holes 10. Bolts 42 may also be installed in the right holes 10 to close the remaining holes 10 visible in the name plate 20. Sharp top edge 4 is shown and notches 6 at each end of it. Pointed end 32 and blunt end 36 appear symmetric to each other in the horizontal position of bracket 30 as shown in FIG. 2, because the non-symmetric portions of the bracket 30 are hidden by plate 2. The reentrant notches 6 each have one side vertical for scraping the edge of a sole and one side horizontal to serve as a guide and rest for the foot.

Figure 3:
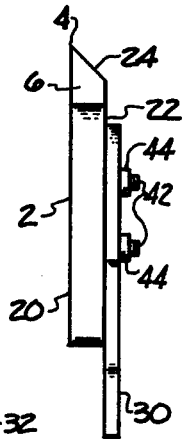
FIG. 3 is a side view of the embodiment and bracket position shown in FIG. 2.

FIG. 3 shows an end view of plate 2 and bracket 30 in its horizontal position for mounting to a license plate holder on a vehicle. The plate 2 in this embodiment is a metal casting and the sharp top edge 4 is formed by bevel 24. The reentrant notches 6 are formed at each top corner of plate 2. The rear surface 22 of plate 2 adjoins bracket 30 and is fastened to it by bolts 42 and nuts 44. The nameplate 20 is formed in relief making the advertiser's name more prominent and thus more easily read. Plate 2 and nameplate 20 could be an edged blade and the nameplate 20 could be embossed, if desired. Symbols and trademarks as well as names may appear on nameplate 20.

If the device is to be used as a bootscraper, two brackets 30 are bolted to the plate 2 through holes 12 and slot 18 making the long straight sides 34 of the two brackets adjacent to each other, extending downward and at right angles to the edge 4 of the plate. The assembled device is then driven in the earth up to a ground line 56 or to any level desired. The device can also be set in concrete by embedding the extending portions of brackets 30 into a wet concrete base.

If the user wishes to install the nameplate 20 on his automobile, he bolts a single bracket 30 with its long straight side 34 horizontal to the plate 2 through holes 8 and 14. Slots 18 are then utilized for attachment to the license plate itself or the license plate holder on the vehicle.

Having described the invention with sufficient clarity to enable those familiar with the art to construct and use it, I claim:

1. A combination bootscraper, nameplate and bracket comprising:

a. a plate, on edge, with its long side horizontally disposed, having a straight edge therealong, holes through the metal plate for fastening; a front surface of the plate bearing some form of indicia;

b. a metal bracket having holes for fastening to the metal plate, the bracket being irregular in shape, having a long straight side, a pointed end and a blunt end, the bracket when attached to the plate with its straight side normal to the long side of the plate and the pointed end extending therefrom, forms a stake for supporting the plate and when the bracket is rotated 90° with respect to the plate so that its straight side is parallel to the long side of the plate, the bracket forms a symmetric bracket for attaching the plate to a vertical surface; and c. means for fastening the bracket to the plate when the bracket is in the vertical and in the horizontal position.

2. A combination bootscraper and nameplate as recited in claim 1, wherein the holes in the bracket include a first set for mounting the plate normal to the bracket and a second set for mounting the plate parallel to the bracket.

3. A combination bootscraper and nameplate as recited in claim 1, wherein the blunt end of the metal bracket has a portion similar to the pointd end of the bracket.

4. A combination bootscraper and nameplate as recited in claim 1 in which the metal bracket when positioned with its long straight side horizontal includes slots located therein for mounting to a license plate support on the front of a vehicle.

5. A combination bootscraper and nameplate as recited in claim 1 in which the straight edge of the plate has a reentrant notch at each end, the notch having a vertical edge for scraping the edge of the sole and a horizontal edge serving as a guide.

6. A combination bootscraper and nameplate as recited in claim 1 in which the straight edge of the plate is an acute angled bevel.

7. A combination bootscraper and nameplate as recited in claim 1 including a second identical bracket, the pair of brackets are positioned with their pointed ends down, their long straight sides vertical and adjacent to each other, forming a pair of stakes for supporting the plate.

* * * * *